United States Patent [19]

Erwin et al.

[11] Patent Number: 4,973,190

[45] Date of Patent: Nov. 27, 1990

[54] BARREL AND BARREL BASE

[75] Inventors: Carl L. Erwin, Brea, Calif.; Dusan Krulj; Herbert J. Kramer, both of St. Louis, Mo.

[73] Assignee: Flex-O-Lite, Inc., St. Louis, Mo.

[21] Appl. No.: 487,534

[22] Filed: Mar. 2, 1990

[51] Int. Cl.[5] ..... E01F 9/00

[52] U.S. Cl. ..... 404/10; 404/9; 116/63 R; 116/63 P

[58] Field of Search ..... 404/9, 10; 256/64; 116/63 P, 63 R

[56] References Cited

U.S. PATENT DOCUMENTS

| | | | |
|---|---|---|---|
| 4,006,702 | 2/1977 | St. Cyr | 116/63 P |
| 4,040,759 | 8/1977 | Skalle | 404/6 |
| 4,071,224 | 1/1978 | Gilbert | 116/63 P |
| 4,083,033 | 4/1978 | Kulp et al. | 256/64 |
| 4,201,975 | 5/1980 | Marcus | 116/63 T |
| 4,298,186 | 11/1981 | Glass | 404/6 |
| 4,475,101 | 10/1984 | Kulp et al. | 116/63 R |
| 4,674,431 | 6/1987 | Cory | 116/63 P |
| 4,710,053 | 12/1987 | Kulp et al. | 404/9 |
| 4,782,783 | 11/1988 | Kulp et al. | 404/9 |
| 4,852,511 | 8/1989 | Look et al. | 116/63 P |

*Primary Examiner*—Ramon S. Britts
*Assistant Examiner*—Roger J. Schoeppel
*Attorney, Agent, or Firm*—Edward H. Renner

[57] ABSTRACT

Traffic control devices are employed for providing temporary delineation and demarcation of traffic lanes in order to guide the flow of traffic through detours, construction areas, and the like. Normally, ballasts used with traffic control elements have been bags containing a stabilizing material such as sand. Such traffic control elements are subject to improvement. They do not permit the stabilizing material to be spread uniformly across the bottom of the traffic control element. Sandbags become lodged against one side of the traffic control element during assembly, or they are thrown against one side on impact. And none of the stabilizing materials in use lend themselves to disassembly and transportation when the traffic control elements are moved to a new hazardous site. Such shortcomings are overcome by the improvement herein.

9 Claims, 3 Drawing Sheets

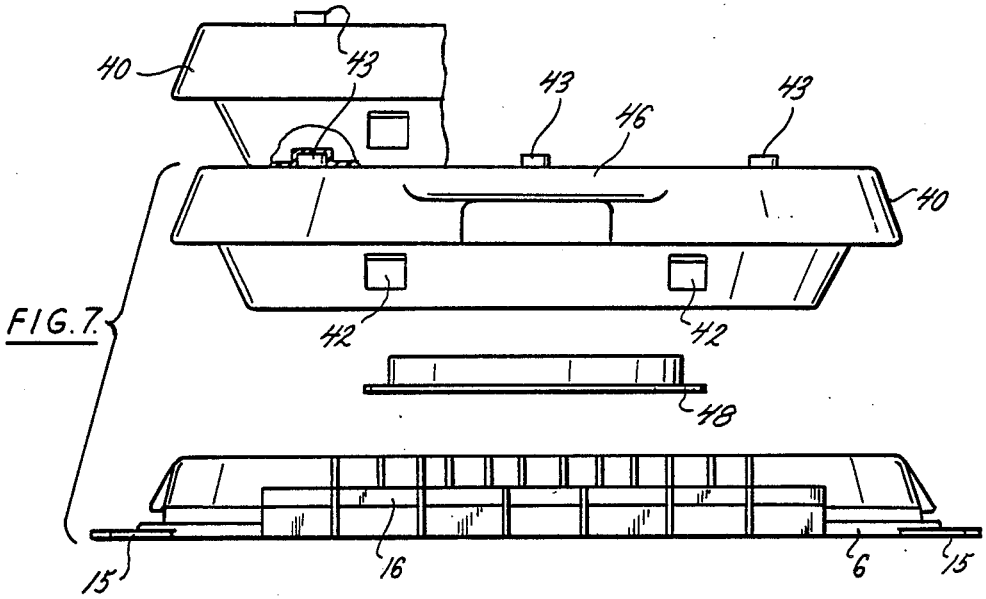
FIG. 7.
FIG. 5.
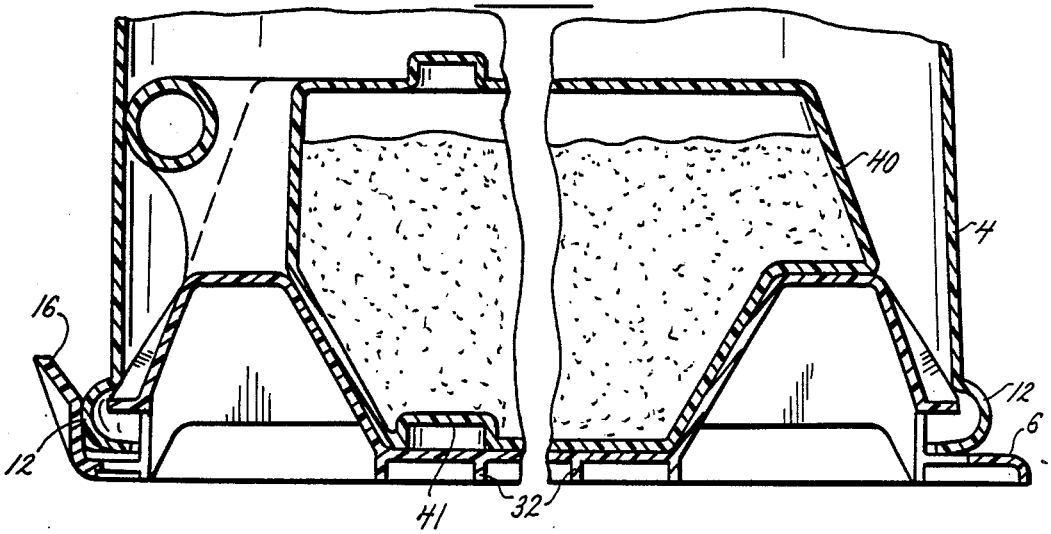
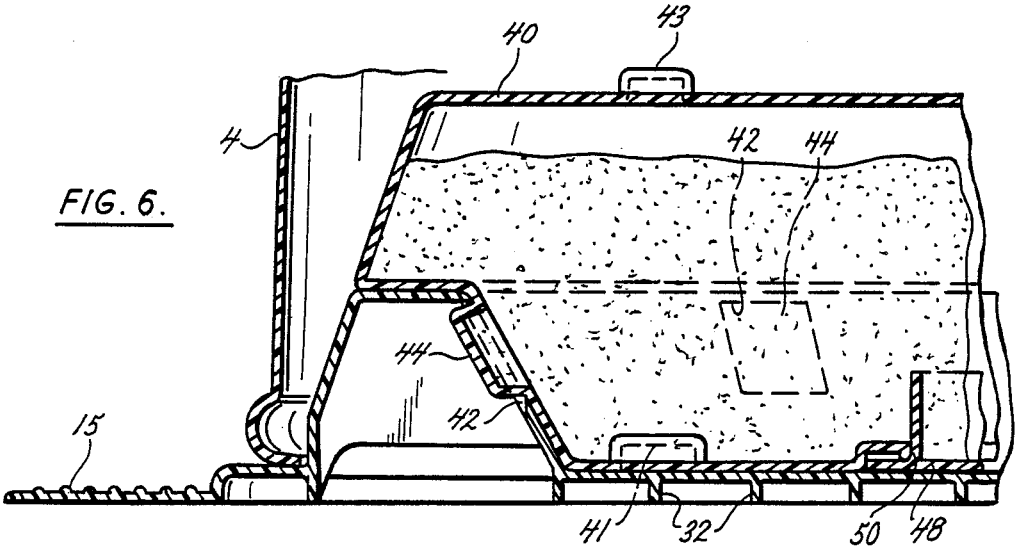
FIG. 6.

BARREL AND BARREL BASE

FIELD OF THE INVENTION

This invention relates to traffic control elements or traffic channelizers which are formidable, bright colored, objects used to close off hazardous areas, or caution motor vehicle operators against proceeding beyond such traffic channelizers into areas being repaired. In one of its aspects the invention is concerned with so called two piece traffic control elements. In still another aspect the invention pertains to ballast means for traffic control elements.

BACKGROUND OF THE INVENTION

Traffic control devices warn vehicle operators of hazards on the non-traffic side of such traffic channelizers. They are also employed for providing temporary delineation and demarcation of traffic lanes in order to guide the flow of traffic through detours, construction areas, and the like.

Traffic channelizers are widely used, and well known in the art, examples being found in such patents as U.S. Pat. No. 4,083,033 and U.S. Pat. No. 4,710,053, the disclosures of which are incorporated by reference herein. They are traffic control devices in the form of barrels or cones, standing as barriers, to discourage crossing the lanes onto the other side thereof. Metallic drums have been employed as traffic channelizers. However to avoid problems which developed during their use, such metal drums have, for the most part, been replaced by plastic traffic channelizers. Present day plastic traffic channelizers are either one-piece traffic control devices, or two-piece channelizing devices, which can be assembled in a stabilized condition at the site.

It has been found that, unlike metal traffic channelizers, some motorists intentionally hit light weight, plastic traffic control elements, knowing that no harm will result to their vehicles. Such impacts displace the channelizers and they must then be returned to their intended location. An advantage of molded plastic traffic control elements is that they can be readily towed or dragged along the ground to return them to their intended location, to place them in a new channelizing location or in a storage area. In addition, some one-piece channelizing devices have open tops which can be readily grasped by an individual when they are moved.

An additional advantage of one-piece traffic control devices is that such channelizing elements, come to rest more predictably near their original channelizing positions, when hit, because of their ballasts. A disadvantage of some one-piece traffic control devices is that they are not easily stackable. Hence they require larger vehicles when they are transported to and from hazard sites. They are bulky and therefore much more inconvenient to move to working areas. In addition if the stabilizing means or ballasts are inaccessibly stored inside them, they are more troublesome to use. Another disadvantage of single piece, or non-breakaway type, channelizing devices is that they may be damaged more extensively on impact than two-piece channelizing devices. Two-piece traffic control elements, on the other hand, are frequently separated on impact by an automobile rather than being damaged by that impact. Another advantage of two-piece traffic control elements is that they can be more readily stacked in a tight nesting relationship for transportation to and from a hazard site.

It can be seen that traffic control elements have been extensively investigated. There are, nevertheless, still areas of improvement, particularly in the stabilization of the traffic control elements with ballasts. Relative to the importance of ballasts, it was pointed out in U.S. Pat. No. 4,710,053, that traffic control elements have a tendency to slide on their supporting surfaces when a gust of wind is suddenly created by a passenger vehicle, truck, or by natural forces. In addition, traffic channelizers utilized on bridge approaches are subject to vibrations caused by the passing motor vehicles causing them to slide from their desired positions.

Normally, ballasts used with traffic control elements have been one or more bags containing a stabilizing material such as sand. In some one-piece traffic control elements, such as cones and the like, the stabilizing material may be closed in, or poured in the unit. But handling and storing problems, already significant, may be multiplied thereby. Two-piece traffic channelizers or open top one-piece traffic control units are preferred because ballasts can be inserted in them during assembly. Even these traffic control elements, however, are subject to improvement. They do not permit the stabilizing material to be spread uniformly across the bottom of the traffic control element. Rather, sandbags confine the stabilizing material so that it cannot be spread across the bottom. Moreover sandbags become lodged against one side of the traffic control element during assembly, or they are thrown against one side on impact. Further, none of the stabilizing materials in use lend themselves to ready disassembly or transportation when the traffic control elements are moved to a new hazardous site. Such shortcomings are overcome by the improvement herein.

SUMMARY OF THE INVENTION

This invention provides a two-piece stackable traffic control element, or an open-top one-piece traffic control element which is more stable when positioned at the site than those previously utilized. The two-piece traffic control element includes a hollow top element having a preselected configuration, and a base element separate therefrom for transportation purposes, but adapted to be readily assembled therewith. In use the hollow element is releasably mounted on the base element. In the open-top one-piece traffic control element the inside base is accessible. In both traffic channelizers a ballast is employed to weight down the traffic control element when it is arranged in a traffic controlling position. In the past sandbags were used as ballast means. By the practice of this invention an improved ballast is provided in the form of a canister adapted to seat within the base for increased stabilization of the assembly. The canister is capable of holding the stabilizing material, and in so doing it keeps the material from moving and shifting within the traffic control element, and from falling against one side, usually the flat side of the traffic control element, when the element is dragged to a new location as is described in U.S. Pat. No. 4,710,053. Closure means for the canister prevent the stabilizing material from spilling during assembly, transportation and impact.

DETAILED DESCRIPTION OF THE INVENTION

Briefly, the traffic control element of this invention includes a stabilizing canister configured for a pressure fit when inserted in the traffic control element base. This and other features of the invention can, perhaps, be better understood by a description of a two-piece traffic control element in conjunction with the accompanying drawings which can be summarized as follows.

BRIEF DESCRIPTION OF THE DRAWINGS

FIG. 5 is a partial sectional view taken along the line 5—5 of FIG. 4;

FIG. 6 is a partial sectional view taken along the line 6—6 of FIG. 3;

FIG. 7 is an exploded view, with portions shown in section, of the two-piece traffic control element base shown in FIG. 2.

DESCRIPTION OF THE PREFERRED EMBODIMENT

Figure 1:
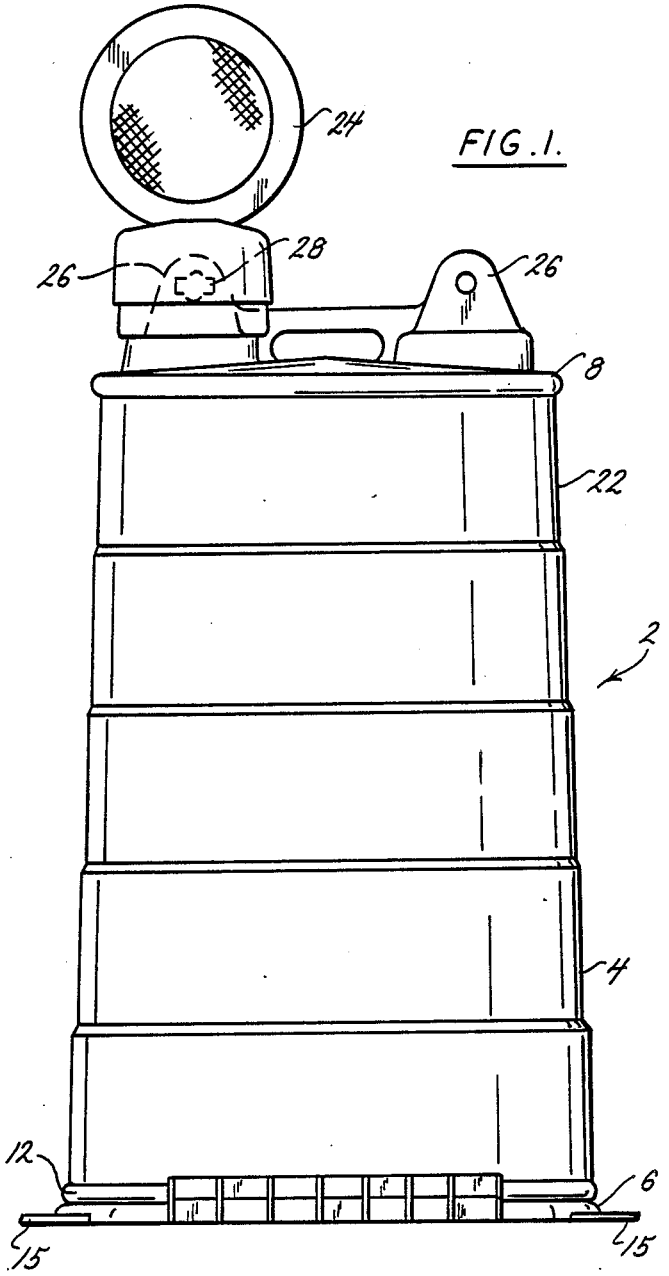
FIG. 1 is a side elevation view of a two-piece traffic control element.
Figure 2:
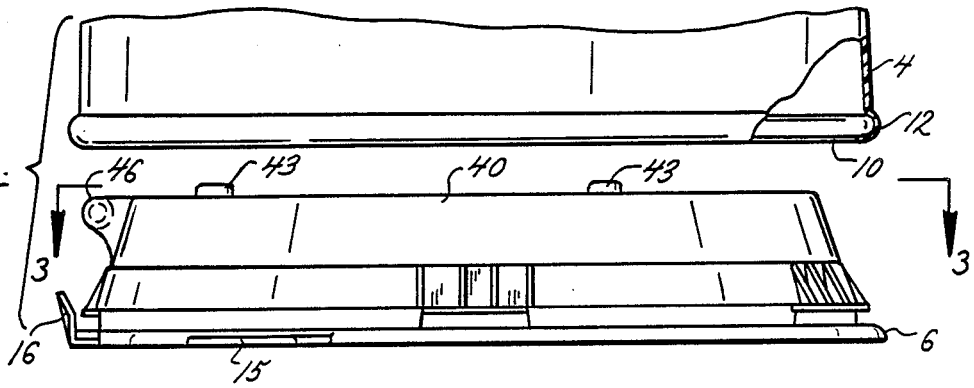
FIG. 2 is an exploded view, with portions in section, of the lower end of the upper hollow element of the traffic control channelizer and the base element.

Prior to describing the invention in detail, it will be helpful to consider the features of known traffic control elements. Referring to FIG. 1, a conventional traffic channelizer 2 is illustrated. A multiplicity of such traffic control elements are arranged in a pre-selected alignment for traffic channelization, for instance, when it is desired to signal a hazard in a lane in which a motor vehicle is approaching, to cause the motorist to change lanes. Traffic control devices 2 are generally constructed so as to be roll resistant even though they resemble barrels. To this end they generally have one slightly flat side so that when the device is knocked into a horizontal position, the traffic control element will come to rest on this flat side, preventing further movement of the device. One-piece and two-piece traffic control elements have been mentioned. Two-piece elements, as shown in FIG. 1, include a traffic channelizer body 4 and a base element 6. The traffic channelizer body, or top element 4, is a hollow element with a closed top 8 and an open bottom end 10. Traffic channelizer top element 4 is adapted to be releasably interlocked with base element 6 as shown in FIG. 2. The bottom end 10 of top element 4 is provided with a locking lip 12 defined around the periphery thereof, and designed to extend inwardly from the outer wall of top element 4 for engaging a coacting locking element defined on base element 6. Base element 6 is provided with interlocking elements or locking tabs 14 securing traffic channelizer body to base element 6. A plurality of security tabs 16 are also provided extending upwardly a sufficient distance to keep locking lip 12 and locking tab 14, interlocked to prevent unintentional separation of the top and base elements. Foot tabs 15 are provided to allow an individual to place a foot on a tab or tabs for releasing the locking lip 12 when it is necessary to disengage the two elements.

In addition to its hollow structure, and its D shaped cross section, traffic control element 2 can have a stepped configuration as shown in FIG. 1 with the largest cylindrical section 20 resting on the base element 6, and with successively decreasing diameter cylindrical sections from the bottom of the control element to its top cylindrical section 22. This stepped configuration permits a plurality of traffic control elements 2 to be stacked in nesting relationship for transportation.

The top end 8 of smaller cylindrical section 22 of traffic channelizing element 2 is adapted to hold a pair of warning lights such as light 24. A pair of light holders 26 are constructed integrally with channelizer top 8. A bolt (not shown) is threadably secured in a nutplate when the warning light is mounted on light holder 26. A security cap 28 is generally provided for the warning light bolt for anti-theft purposes.

Figure 3:
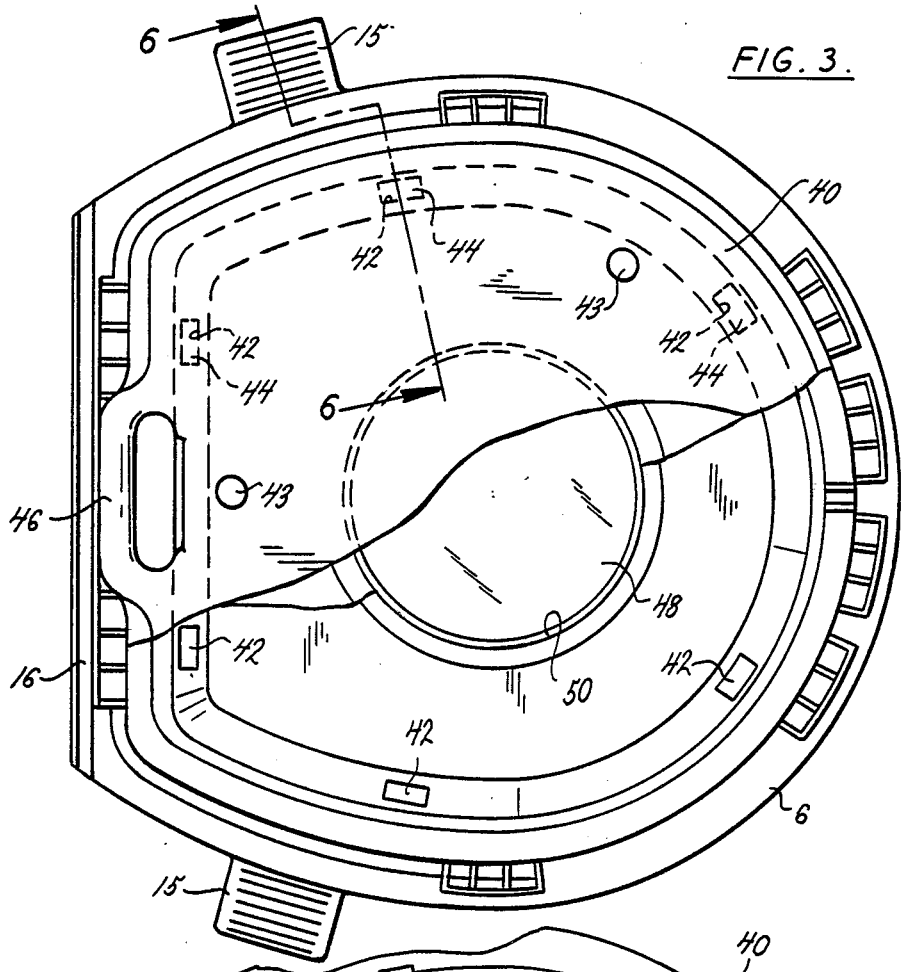
FIG. 3 is a partial plan view of the detached base element taken along 3—3 of FIG. 2.

Turning now to FIG. 3, the base element 6 is shown therein. In addition to locking onto the top portion 4 of the traffic channelizer through locking lip 12, one of the functions of the base element is to hold a ballast means, which in the past, included sacks of a stabilization material such as sand. When the sandbags are not inside the traffic control elements 2, they are frequently placed either on top of the traffic channelizing element near its light or on the foot tabs 15. In either case such sandbags render the traffic control element both unsightly and unstable. In order to support the stabilizing material, the inside surface 34 of base element 6 has a flat bottom adapted to hold sandbags. This flat bottom can be considered as a storage tray on which the sandbags rest.

Figure 4:
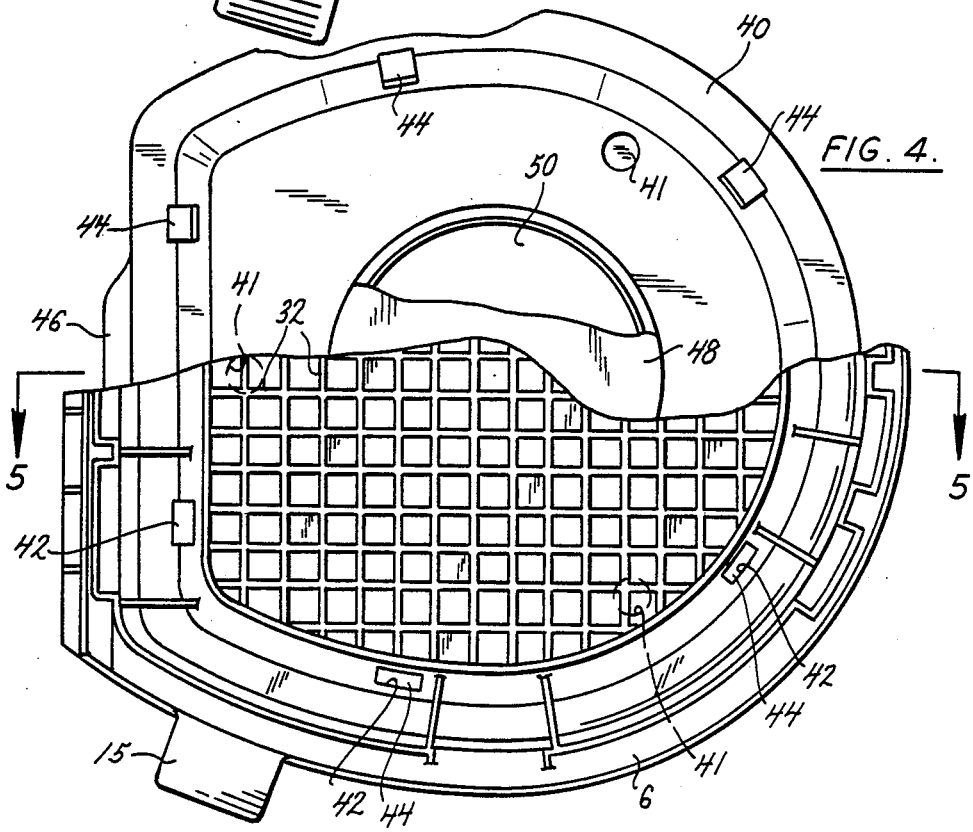
FIG. 4 is a partial bottom plan view of the base element illustrating in FIG. 2.

As indicated herein before it is important to distribute the weight of the ballast, that is the stabilizing material, over the entire area of the base element. To this end the opposite side of the flat base surface has a waffle pattern 30 (FIG. 4) formed by a multiplicity of dependent elements 32 covering the central surface-engaging portion of bottom element 6. As shown in FIG. 4, these dependent elements form a multiplicity of squares which engage the road surface to increase traction.

Present sandbag ballasting is subject to an inherent shifting of the stabilization material load. Any lateral movement of the channelizing element 2 will cause the sandbag, due to inertia, to shift in the opposite direction. In addition even though dependent elements 32, FIGS. 1, 2 and 7, are provided on the bottom of base element 6, the stabilizing material cannot be distributed evenly across the inside flat surface 34 of base element 6. Another drawback, insofar as the use of existing stabilization materials is concerned, is that they are an additional article requiring care and handling. Sandbags are frequently torn when thrown on other apparatus. Further, the sandbags, the base element 6, and the upper hollow element 4, cannot all be carried at the same time. Two trips are required when the traffic control element 2 in its disassembled form, is to be moved, or loaded for transport.

By the practice of this invention, the stabilizing material is so confined that it cannot pile up on one side of the base element 6. The ballast includes a canister 40 holding the stabilizing material so that it cannot shift. Canister 40 is clasped by base element 6 so that the two can be carried as a single unit. In this connection reference is made to FIG. 7 which is an exploded view of the base element-ballast combination. Canister 40 is shown, along with base element 6. From FIG. 5 it is clear that canister 40, constructed to hold a stabilizing material such as sand, is adapted to seat in base element 6. Locking means in the form of locking ears 42 shown in FIGS. 5, 6 and 7 are configured to snap into their corresponding locking recesses 44, one being in the base element 6, the other being in or on the canister. When seated, the ballast appears as shown in FIGS. 4 and 5 with locking ears 42 held by locking recesses 44. FIGS. 5 and 6 also show the top hollow element 4 locked in place through locking lip 12 and held by security tabs 16. Canister 40 is provided with a handle 46 so that the ballast, with or without base element 6, can be carried. The canister is also provided with a lid 48 closing an opening 50 for changing, removing or adding stabilizing material. In its preferred embodiment, lid 48 will close an opening in the bottom of the canister. This has the advantage that with the canister locked in base element 6 as shown in FIG. 3, the combination, with the weight of the stabilizing material, renders much less likely the possibility that the lid will pop out.

Moreover, due to the flat configuration of canister 40, as shown in FIG. 7, the canister 40 is readily stackable. Stack stability of canisters 40 is maintained by an interlock of elements 41 and 43. Elements 41 and 43 are located on the flat top and bottom surfaces of canister 40, as shown in FIGS. 5, 6 and 7. Elements 41 are recesses in the bottom surface of canister 40. Elements 43 are projections on the top surface of canister 40. Recesses 41 and projections 43 engage when canisters 40 are stacked and hold canisters 40 secure against lateral displacement. It will be appreciated that the order and position of elements 41 and 43 may be reversed.

It can be seen that an extremely stable and adaptable ballast is provided by this invention. It will provide an even distribution of stabilization material. It will prevent shifting of stabilizing material. And it will inhibit drifting of the traffic control element as a result of traffic and other wind gusts. Further it will be much easier to transport and assemble. Having been given the teachings of this invention ramifications will occur to those skilled in the art. Thus, to improve its stability, a top opening traffic channelizing element can also be adapted to hold the ballast of this invention, in a manner similar to that shown in FIG. 5, if base 6 and top 4 are formed as one piece. These and other embodiments which will be obvious to those in the field are deemed to be within the scope of this invention.

Applicants are not to be limited to the details of their embodiments shown herein for illustration purposes, but only by the scope of the claims appended hereto, and their equivalents.

What is claimed is:

1. In a traffic control element which includes a hollow top element having a preselected configuration, an accessible base element, and a ballast weighting down the traffic control element when it is arranged in a traffic controlling position, an improved ballast comprising a canister adapted to seat within the base element to be held thereby for increased stabilization of the assembly, the canister being capable of confining and holding the stabilizing material, closure means for said canister preventing the stabilizing material from shifting during use, and from spilling during assembly, transportation, and impact.

2. The traffic control element of claim 1 wherein the hollow top element has a base element separate therefrom for transportation purposes, but wherein the traffic control element is adapted to be readily assembled with the hollow element releasably mounted on the base element with the canister seated in the base element.

3. The traffic control element of claim 2 wherein the canister is configured to snap in when inserted in the base element.

4. The traffic control element of claim 2 wherein the base element has an inner configuration such that its inner contour and the contour of the canister are substantially symmetrical.

5. The traffic control element of claim 2 wherein the base element and the canister are provided with means locking the two together when the canister is inserted in the base element.

6. The traffic control element of claim 2 wherein the canister closure means is positioned in the canister bottom to be between the base element and the canister when the canister is inserted in the base element, providing improved retention and protection of stabilizing material on impact.

7. A ballast-containing canister adapted to stabilize a barrel-type traffic control element, the canister having means for confining a ballasting material, a hollow interior in the canister and removable means for providing access to the interior of the canister, the removable means being replaceable to seal the interior of the canister, means seating the canister in the base of a traffic control element, and locking means for fastening the canister to cooperating locking means in the base of a traffic control element.

8. The canister of claim 7 having at least two flat opposite sides so that it is stackable.

9. The canister of claim 8 having means for stabilizing canisters against lateral displacement during stacking for storage.

* * * * *